US006760934B1

(12) United States Patent
Leach

(10) Patent No.: US 6,760,934 B1
(45) Date of Patent: Jul. 13, 2004

(54) SYMMETRICALLY CONTOURED SUPPORT PILLOW

(76) Inventor: Jamie S. Leach, P.O. Box 717, Ada, OK (US) 74820

( * ) Notice: Subject to any disclaimer, the term of this patent is extended or adjusted under 35 U.S.C. 154(b) by 0 days.

(21) Appl. No.: 10/640,622

(22) Filed: Aug. 14, 2003

(51) Int. Cl.[7] ..... A47G 9/00
(52) U.S. Cl. ..... 5/632; 5/631; 5/930
(58) Field of Search ..... 5/632, 631, 930, 5/636, 640, 644; D6/601, 596

(56) References Cited

U.S. PATENT DOCUMENTS

| | | | | |
|---|---|---|---|---|
| 2,795,802 A | | 6/1957 | Myers | 5/632 |
| D201,492 S | | 6/1965 | Jacobson | D6/601 |
| 4,173,048 A | | 11/1979 | Varaney | 5/636 |
| 4,236,264 A | * | 12/1980 | Britzman | 5/644 |
| 5,026,315 A | | 6/1991 | Chap | D6/601 |
| 5,647,076 A | | 7/1997 | Gearhart | 5/631 |
| 5,978,990 A | | 11/1999 | Akey | 5/632 |
| 5,987,674 A | | 11/1999 | Schaffner et al. | 5/630 |
| D420,845 S | | 2/2000 | Rumage | D6/601 |
| 6,052,848 A | | 4/2000 | Kelly | 5/632 |
| 6,088,854 A | | 7/2000 | Brownrigg | 5/632 |
| 6,499,164 B1 | | 12/2002 | Leach | 5/632 |

* cited by examiner

*Primary Examiner*—Alexander Grosz
(74) *Attorney, Agent, or Firm*—William S. Dorman

(57) ABSTRACT

A symmetrical contoured support pillow formed essentially in an inverted U-shape, comprising essentially a semi-circular crown designed to support the head of a woman and a pair of spaced symmetrical legs extending downwardly and outwardly divergently away from the crown, the legs having lower ends which are curved inwardly towards each other and forming toes, each leg having a convex bulge extending inwardly in the space between the two legs, the bulges extending towards each other, the resulting space between the legs as formed by the convex bulges being essentially in the shape of an hourglass, the woman lying between the legs of the pillow on her side such that one of the bulges is received in a curvature of the back of the woman whereas the other bulge is received in a tummy area of the woman.

3 Claims, 4 Drawing Sheets

SYMMETRICALLY CONTOURED SUPPORT PILLOW

FIELD OF THE INVENTION

The present invention relates to a symmetrically contoured support pillow. More particularly, the present invention involves a contoured stuffed pillow having symmetrically contoured sides to provide support to an adult in a sleeping position or to cradle an expectant mother, each in a variety of positions, without having to adjust the pillow to obtain the correct relationship.

PRIOR ART

A preliminary search was conducted on the present invention and the following patents were uncovered in the search.

| Patent No. | Inventor | Date |
|---|---|---|
| 6,499,164 | Leach | Dec. 31, 2002 |
| 6,088,854 | Brownrigg | Jul. 18, 2000 |
| 6,052,848 | Kelly | Apr. 25, 2000 |
| 5,987,674 | Schaffner, et al. | Nov. 23, 1999 |
| 5,978,990 | Akey | Nov. 9, 1999 |
| 5,647,076 | Gearhart | Jul. 15, 1997 |
| 5,026,315 | Chap | Jun. 25, 1991 |
| 4,173,048 | Varaney | Nov. 6, 1979 |
| 2,795,802 | Myers | Jul. 9, 1951 |
| D420,845 | Rumage | Feb. 22, 2000 |
| D201,492 | Jacobson | Jun. 29, 1965 |

The Kelly Pat. No. 6,065,848 does not show the contours of the inner design of the present invention. Kelly is simply a U-shaped pillow with straight edges and does not conform by way of shape to the user's body. The instant pillow is convex shaped on the inner mid sections making it conform to the body and allows for greater back or belly support. The ends of the pillow allow it to turn inward and meet which provides for even greater support without having to constantly reposition the pillow. In Kelly, the ends are straight and not curved. Kelly requires a band to have it pulled inward, where the instant pillow, by the way it is shaped, naturally curves inward at the ends.

The Brownrigg Pat. No. 6,088,854, again, is just a straight form of an elongated pillow that has to be folded and pulled inward to achieve the amount of support or shape that the user desires. It appears to also have to use a separate traditional pillow for head support. The instant pillow has its own head pillow in the form of a semi-circular crown at the upper part of the pillow.

Leach Pat. No. 6,499,164 does not allow for equal amounts of tummy and back support simultaneously. While there are features of the Leach pillow, such as the horseshoe shaped top, and the J-shaped bottom that does curve around and provide support and cushioning, it is not equal on both sides as the instant pillow is. With the present invention, the user can lie on her right side and receive the same amount of the support as if she were turned on the opposite side. Also, the inner columnar section of the Leach pillow does not have a convex section which fits into the user's lower back, or neck area if the pillow were turned 180 degrees.

Rumage Pat. D420,845 is a design patent and, again, reference should be made to the distinguishing features outlined in relation to Kelly and Brownrigg. The inner section of the pillow is straight and has no convex shape that would fit snugly into the user's lower back or abdomen. Also the ends are rounded and do not come inward towards themselves. They are straight and open. The instant pillow naturally comes together towards itself, with a spring like quality. The Rumage pillow is for the neck and does not have any full body benefits.

Myers Pat. No. 2,795,802 is should be considered in light of the above comments regarding Kelly and Brownrigg.

Jacobson Pat. No. D201,492 is also a design patent and is asymmetrical in its features. It does not support the entire body simultaneously as the instant pillow does, and cannot be crossed over at the ends to provide additional elevation.

Varaney Pat. No. 4,173,048 is quite similar to the Kelly patent. There are no convex contours and the ends are open and not spring-like. Limited support is achieved since it does not conform to the body, but is straight and must be tucked around the body to achieve any level of snugness or support.

Chap Pat. No. 5,026,315 is a toy and not a sleeping device. It has no full body features. The ends are round and open and do not meet. The inner section is straight.

Gearhart Pat. No. 5,647,076 is broadly similar to Kelly and Brownrigg as to one part of the two piece pillow. The Gearhart pillow is designed for a person to lie in the prone or face down position. Also, an extra piece is used to make the pillow widen.

Schaffner et al., Pat. No. 5,987,674 is a non-symmetrical pillow. If the user turns from side to side, she does not receive the same amount of support while turning, as she does with the instant pillow. A pregnant woman must lie on her side predominately during the last few months of her pregnancy. The instant pillow allows her to rest comfortably whether she is on her left side or right side with the same amount of support simultaneously. The side "mirror" each other. The Schaffner pillow does not allow the user to double the ends over each other to achieve greater elevation. It is limited in the amount of full body support it provides.

The Akey Pat. No. 5,978,990 has several separate attachments and extensions. The extensions must be moved and separated from the main pillow to achieve the desired amount of support. The instant pillow is all one piece and the user can pull each independent section closer to the body without having to disengage the pillow as with the Akey patent. Akey does not show an convex bulges.

SUMMARY OF THE INVENTION

The present invention involves an inverted "U"-shaped pillow, the upper end of which is formed by a semi-circular crown for the user's head to rest against. There are two symmetrically and downwardly extending legs which represent the legs of the "U". The legs of the inverted U extend divergently outward and downwardly and terminate in a pair of toes that are curved inwardly towards each other such that they essentially abut or touch each other. The legs are further provided convex bulges essentially midway of the length of the legs, and these bulges project inwardly towards each other. The resulting effect of the inner shape of the opening between the legs resembles a hourglass.

The pillow of the present invention allows the user to sleep on the right or left side without having to reposition, tie, secure or disengage anything from the pillow. Many women are required by their shapes, in the latter part of their pregnancies, to sleep on the side and not on the back as the extra weight and pressure of the baby presses down on the vena cava and disturbs normal blood flow. By sleeping on the side, especially on the left side, it allows normal blood flow and does not cause pressure on the large blood vessels that run posterior to the uterus. The pillow of the present invention allows a person to turn from side to side without having to reposition anything. The convex bulges naturally fit inwardly to the body, back and tummy, and the toes, which curve inwardly, hold the legs in place. If the user desires to turn the pillow up side down, the user can double over the toes and elevate the pillow to get the effect of using two pillows (toes)under the head.

DETAILED DESCRIPTION OF THE PREFERRED EMBODIMENTS

Figure 1:
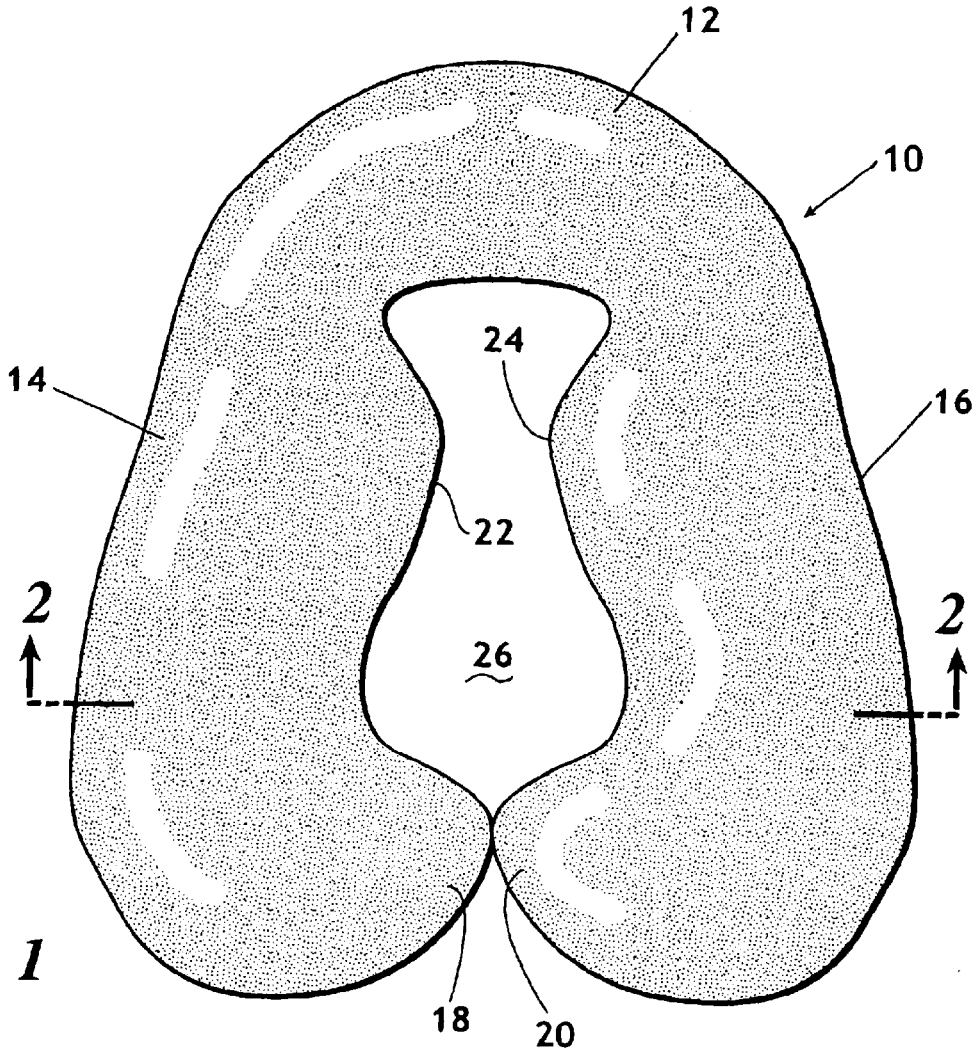
FIG. 1 is a plan view of a contoured body pillow of the present invention in its normal position.
Figure 2:
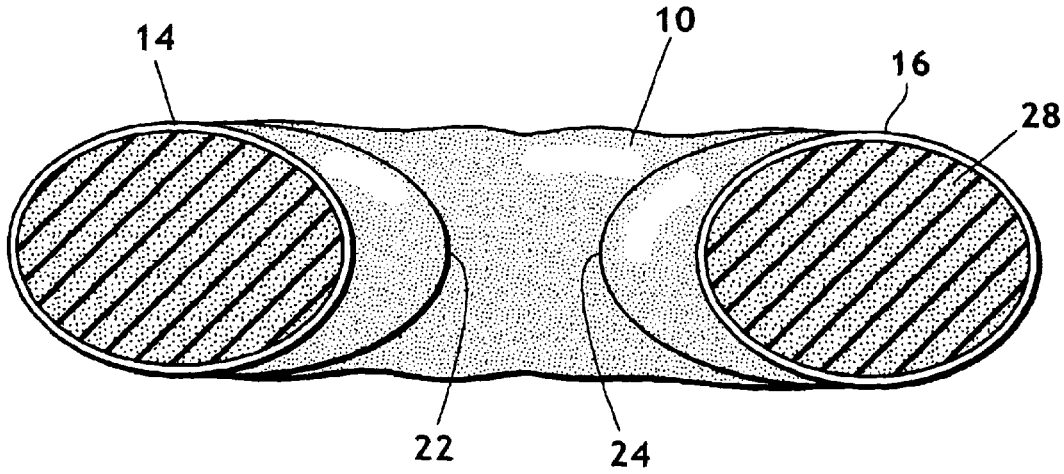
FIG. 2 is a cross-sectional view through the legs of the contoured body pillow of FIG. 1 taken along section line 2—2 of FIG. 1.

Referring to the drawings in detail, FIG. 1 shows a symmetrically contoured support pillow 10 consisting essentially of a semi-circular crown 12 for the user's head to rest against, two symmetrical and downwardly extending legs 14 and 16 having inner protuberances 18 and 20 at the respective ends of the legs. For the sake of convenience, the protuberances 18 and 20 will also hereinafter be referred to as "toes". In the "normal" position of the pillow shown in FIG. 1, the toes 18 and 20 will be just touching each other.

The pillow 10 is designed to accommodate the natural curves of the body (of a woman), to provide support for the back, hips, and/or the stomach of a pregnant woman and to permit the woman to change her resting or sleeping position without having to adjust or reposition the pillow. Alternatively, the pillow can be wrapped around the user in a seated position with the semi-circular crown 12 encircling the stomach area of the user and the downwardly extending legs 14 and 16 being wrapped around the sides of the user with the toes at the ends thereof connecting behind the user to provide back support. The toes 18 and 20 can also function as a head support when overlapped, with the semi-circular crown 12 being positioned between the legs of the user.

The leg 14, on its inner aspect, is provided with a convexly curved bulge 22 while the leg 16, on its inner aspect, is provided with a similarly shaped convex bulge 24 which extends towards the bulge 22 in opposition thereto. The net effect of the symmetrical bulges 22 and 24, considered in light of the space between the arms 14 and 16, is to provide a somewhat hourglass shape 26 between the two legs 14 and 16. The pillow 10 can be stuffed with conventional batting, resilient polyester fiberfill, polystyrene foam beads or any other convenient stuffing material for pillows, as indicated by the reference numeral 28; or it could be manufactured with an inflatable pillow liner and have a cover over the inflatable portion. If desired, the pillow itself could be made of inflatable material. A removeable and washable cover (not shown) can be provided as desired.

Figure 3:
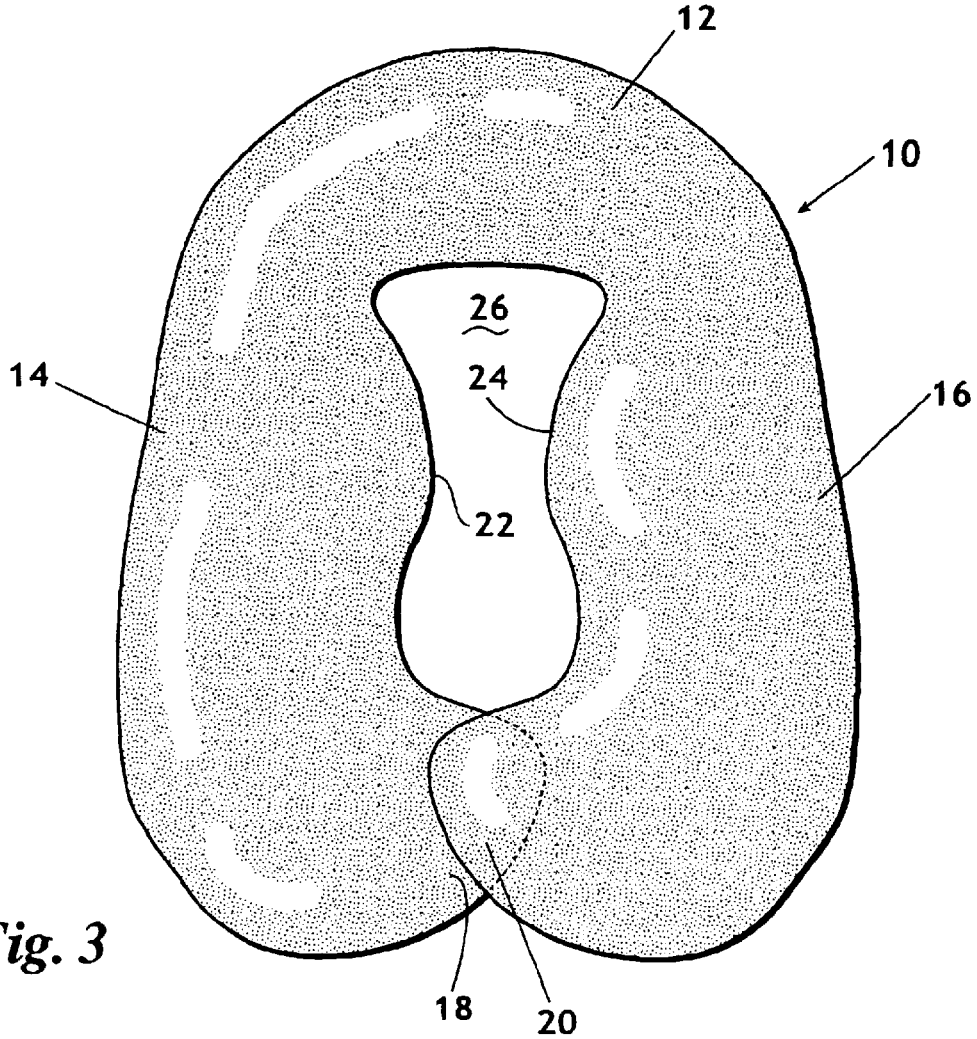
FIG. 3 is a view similar to FIG. 1 but showing the lower ends of the legs in a slightly overlapping condition.

As best shown in FIG. 3, the lower ends of the legs 14 and 16 have been moved closer to each other so that the toes 18 and 20 overlap each other.

Figure 4:
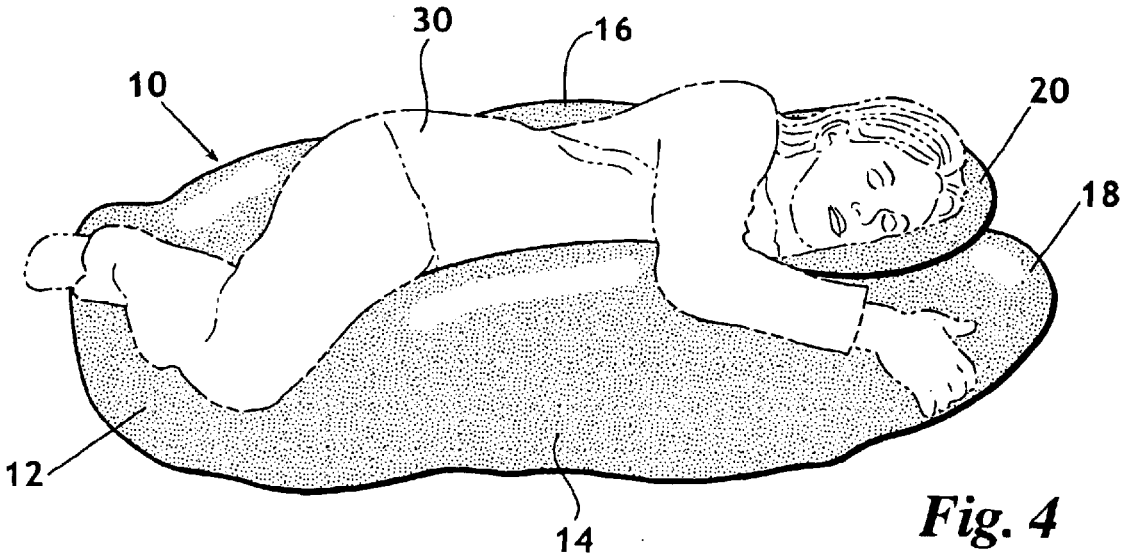
FIG. 4 is a perspective view of a young woman lying on her left side on the contoured pillow of FIG. 3 with her head resting on the overlapping portions.

With further respect to the position of the pillow 10 show in FIG. 3, FIG. 4 shows a woman 30 with her head positioned over the overlapping toes 18 and 20 of the pillow and with her legs straddling the semi-circular arch 12 of the pillow.

Figure 5:
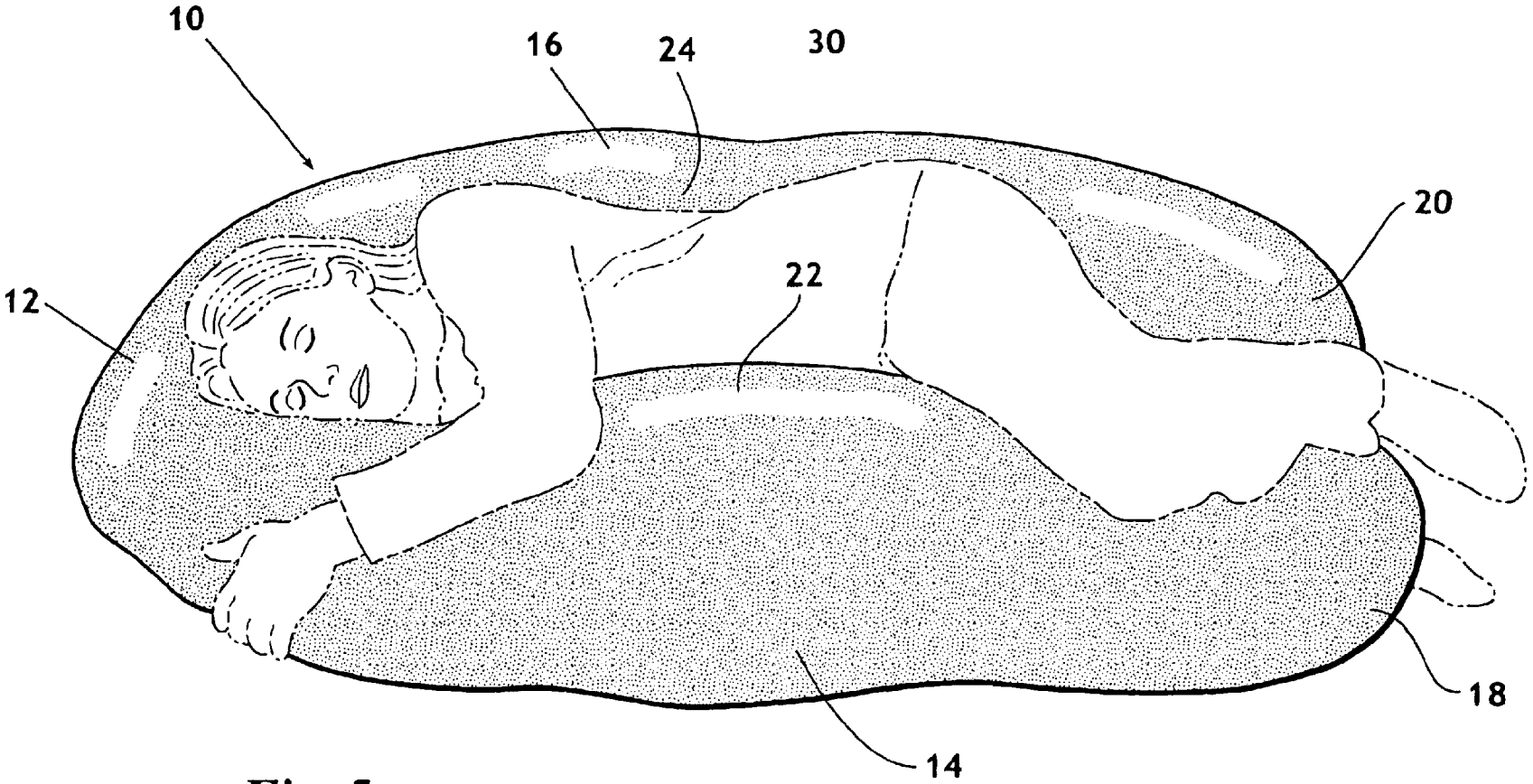
FIG. 5 is a perspective view of a young female lying on the contoured pillow of FIG. 3 on her right side, with her head resting on the crown of the contoured pillow and her legs lying over the ends of the legs of the pillow.

FIG. 5 shows a woman 30 with her head resting on the semi-circular arch 12 and with her legs extending down between the lower ends of the legs 14 and 16. In FIG. 5, the bulge 22 is received against the woman's tummy while the bulge 24 rest against the back of the woman.

Figure 6:
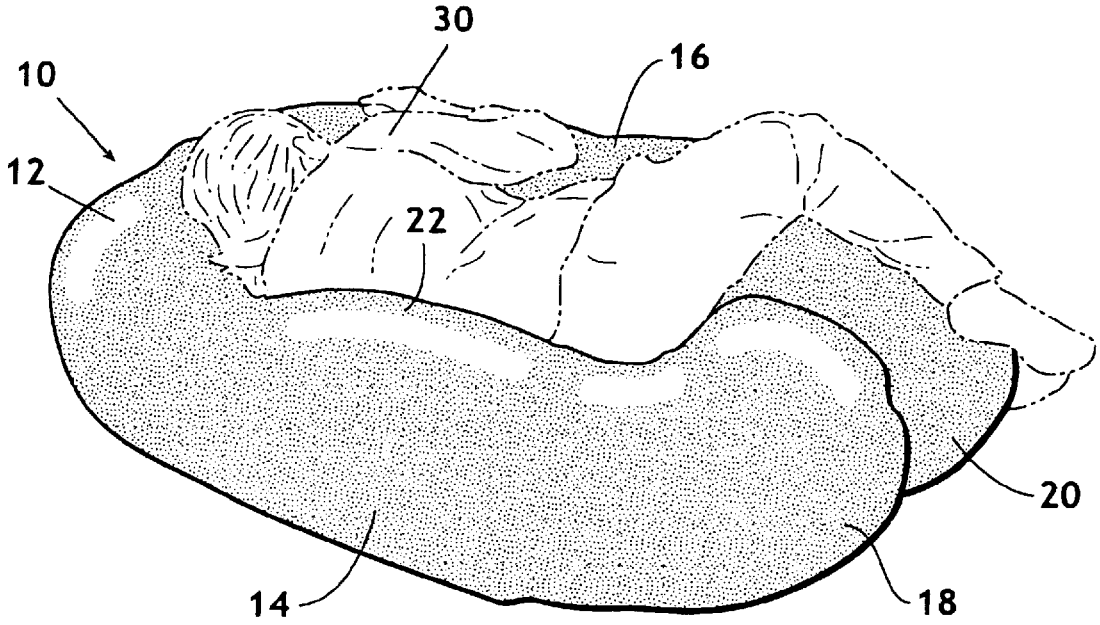
FIG. 6 is a perspective view of a young woman lying her left side on the contoured pillow with her head resting on the crown of the pillow and her legs straddling one of the legs of the pillow.

FIG. 6 shows a woman 30 resting on the pillow 10 in essentially the opposite mode from that shown in FIG. 5, with the exception that the legs of the woman are wrapped around the leg 16 of the pillow 10. The bulge 22 of the pillow shown in FIG. 6 is resting against the curvature of the back of the woman while the opposite bulge 24 (obscured in this view) rests against the tummy of the woman.

Figure 7:
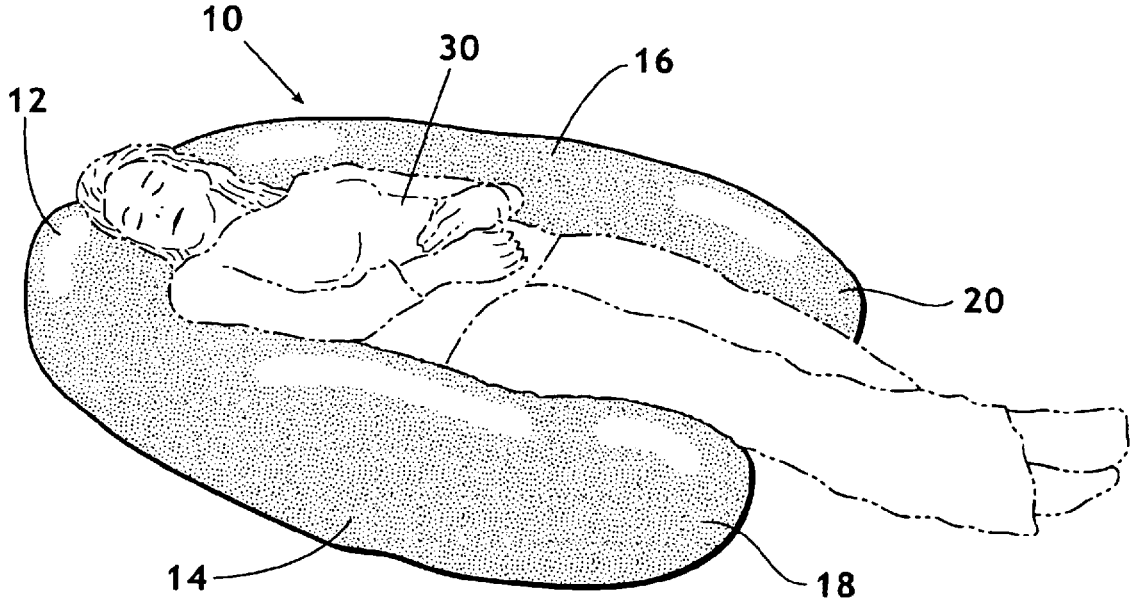
FIG. 7 is a perspective view of a young woman lying on the contoured pillow with her head resting on the crown and her body extending at full length between the ends of the legs of the pillow.

FIG. 7 is a view of the woman 30 with her body fully extended. The woman's head in FIG. 7 is resting against the semi-circular crown 12 while the legs of the woman extend beyond the ends of the legs 14 and 16 and beyond the toes 18 and 20 of these legs.

It can be seen from the above that the pillow of the present invention provides a product which is particularly useful for a pregnant woman. When a woman is expecting, she soon notices that she needs as much support for her growing tummy as for her aching back. The inner contours of the pillow of the present invention are designed to follow the natural curves and shapes of the body of the pregnant woman. No matter how she likes to sleep, the unique design of the present pillow eliminated the need for the woman to constantly change her position during the night. One will simply turn from side to side and the body pillow is a comfort fit for each position. The pillow provides equal support for back and tummy at the same time. One convex bulge is desired to fit into the curvature of the back while the other bulge is designed to fit into the curvature of the tummy.

Turning now to the further consideration of FIG. 3, if the toes 18 and 20 are pulled more towards each other so that a greater degree of overlapping occurs as compared to what is shown in FIG. 3, the toe sections can be pulled to the extent that the bulges 22 and 24 actually touch each other. In this condition an individual lying on the pillow would get full back support by the contiguous bulges 22 and 24. The abutting bulges would prevent rolling from side to side and would provide a "body contoured fit" back support along both sides of the spinal column.

What is claimed is:

1. A symmetrically contoured support pillow formed essentially in an inverted U-shape, comprising essentially a semi-circular crown and a pair of spaced symmetrical legs extending downwardly and outwardly divergently away from the crown, the legs having lower ends which are curved inwardly towards each other and forming toes, each leg having a convex bulge extending inwardly in the space between the two legs, the bulges extending towards each other, the resulting space between the legs as formed by the convex bulges being essentially in the shape of an hourglass.

2. A symmetrically contoured support pillow as set forth in claim 1 wherein the crown is designed to support the head of a woman who is lying between the legs of the pillow on her side such that one of the bulges is received in a curvature of the back of the woman whereas the other bulge is received in a tummy area of the woman.

3. A symmetrically contoured support pillow as set forth in claim 1 wherein the toes are moved towards each other to create an overlapping condition, wherein the head of the woman is adapted to rest on the overlapping toes while one bulge is received in the curvature of the back of the woman and the other bulge is received in the tummy area of the woman.

* * * * *